United States Patent [19]

Askew

[11] Patent Number: 5,020,979

[45] Date of Patent: Jun. 4, 1991

[54] INJECTION PUMP HAVING PILOT AND MAIN INJECTION

[75] Inventor: James M. A. Askew, Brockworth, Great Britain

[73] Assignee: Lucas industries PLC, United Kingdom

[21] Appl. No.: 417,273

[22] Filed: Oct. 5, 1989

[30] Foreign Application Priority Data

Oct. 6, 1988 [GB] United Kingdom ..... 8823453

[51] Int. Cl.[5] ..... F04B 7/04; F02B 3/00

[52] U.S. Cl. ..... 417/499; 123/300; 123/503

[58] Field of Search ..... 417/494, 497; 123/229, 123/300, 501, 503

[56] References Cited

U.S. PATENT DOCUMENTS 3,792,692 2/1974 Kiley ..... 417/494

FOREIGN PATENT DOCUMENTS 2131195 6/1971 Fed. Rep. of Germany ..... 123/300

550050 12/1942 United Kingdom ..... 123/503

*Primary Examiner*—Leonard E. Smith

*Assistant Examiner*—John A. Savio, III

*Attorney, Agent, or Firm*—Flehr, Hohbach, Test, Albritton & Herbert

[57] ABSTRACT

The invention is drawn to a pump having a piston which is reciprocable within a cylinder. The cylinder has a closed end including a liquid outlet and port means to introduce a liquid into the closed end of the cylinder. The piston has on its peripheral surface a helical groove means fluidly connected to the closed end of the cylinder and a second groove to communicate the port with the closed end of the cylinder when the piston is in a position between a location in which the port directly communicates with the closed end of the cylinder and a location in which the port communicates with the helical groove means. The second groove in the peripheral surface of the piston is located between the helical groove means and the part of the piston adjacent to the closed end of the cylinder. The second groove also communicates with a cutaway portion in the wall of the cylinder that is coaxial with the axis of the port.

7 Claims, 3 Drawing Sheets

INJECTION PUMP HAVING PILOT AND MAIN INJECTION

The present invention relates to a pump and is particularly applicable to a liquid fuel injection pump for use with a fuel injection system for an internal combustion engine of the compression ignition type.

In compression ignition type fuel injection systems, for each cylinder of the engine there is provided an injector which injects fuel at the relevant time during the movement of the piston in the cylinder, the fuel being pumped to the injector via a delivery valve which receives fuel from a fuel pump. The fuel pump comprises a piston and cylinder arrangement (usually referred to as a plunger and barrel), the plunger being reciprocated in synchronism with rotation of the engine.

Figure 1:
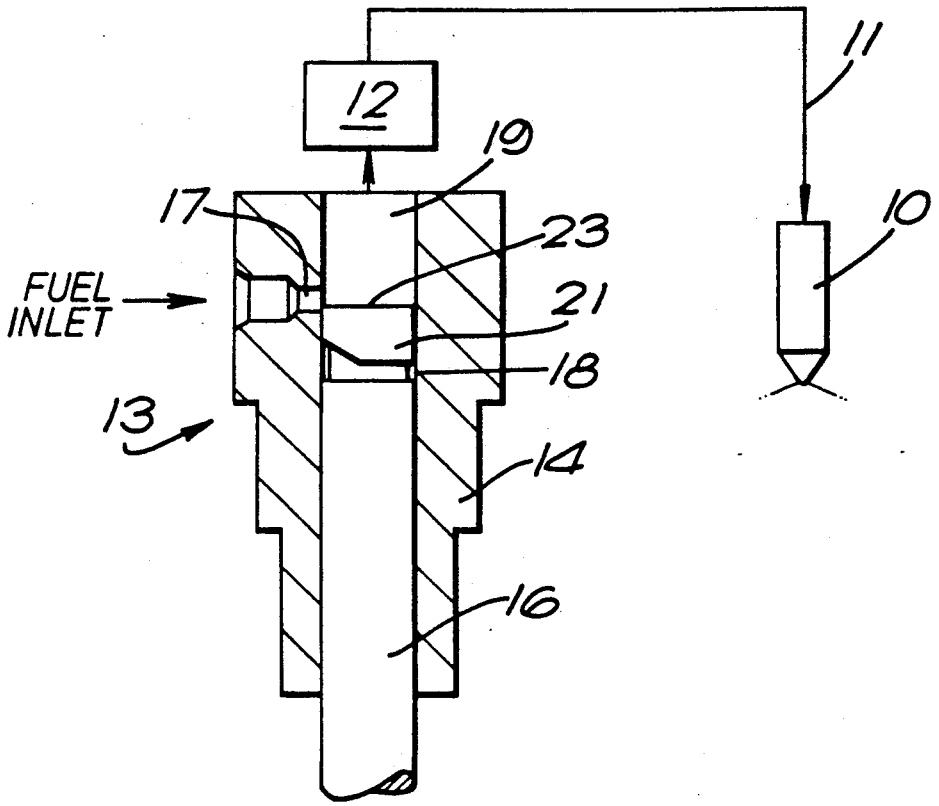
FIG. 1 (PRIOR ART)
Figure 2:
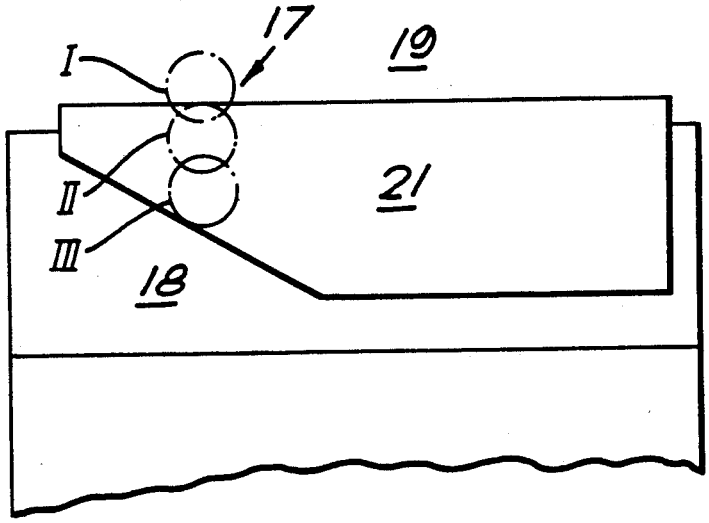

A common arrangement is illustrated in FIGS. 1 and 2, in which FIG. 1 is a diagram showing a conventional injection system including on injector 10, fuel line 11, delivery valve 12 and fuel pump 13 showing in particular the arrangement of the fuel pump barrel 14 with a fuel inlet port 17 and plunger 16, and FIG. 2 is a developed view of the upper portion of the plunger 16 and the adjacent port 17 in the barrel wall.

In the arrangement of FIG. 1, fuel is fed to the closed end 19 of the cylinder barrel 14 through the port 17 in the cylinder barrel wall, and as the plunger 16 moves up past the port 17 it initially closes the port 17, whereby fuel in the closed end 19 of the barrel 14 is pumped via the delivery valve 12 and fuel line 11 to the injector 10.

In order to vary the amount of fuel pumped, the circumferential face 21 of the plunger 16 includes a helical groove 18 which extends to the front (upper) surface 23 of the plunger 16. Clearly, when the plunger 16 has moved sufficiently far forward (upwards) that the helical groove 18 and the port 17 are in communication, then pressure above the plunger (in the closed end 19 of the barrel) is relieved via the groove 18 so that pumping of the fuel to the delivery valve 12 ceases. Because the groove 18 is of helical shape, relative rotation of the barrel 14 and plunger 16 will cause the helical groove 18 to communicate with the port 17 at different axial positions of the plunger 16. In practice, it is usually arranged that the plunger 16 is rotable about its axis by a rack and pinion arrangement, not shown, and in this way the amount of fuel pumped for each cycle of the fuel pump is controlled.

FIG. 2 shows a developed view illustrating the relative positions of the circumferential surface 21 of the fuel pump plunger 16, the helical groove 18 and the port 17. In practice, the plunger 16 moves up and down, but for ease of drawing the port 17 is shown as moving with respect to the plunger 16. Thus, the circumferential surface 21 of the plunger 16 is in sealing communication with the wall of the barrel and the helical groove 18 (or part helical groove) is shown.

In the initial relative position of the plunger 16 and port 17 (in which the port is indicated at position I) the port and the closed end 19 of the barrel above the plunger are in communication and movement of the plunger does not compress the fuel above the plunger.

When the position of the port is as shown at II the port 17 is closed by the circumferential surface 21 of the plunger and movement of the plunger upwardly compresses the liquid in the closed end 19 of the barrel and hence the liquid will be delivered to the injector.

When the relative position of the plunger and port is as shown at III, the port begins to communicate with groove 18 and so, further movement of the plunger upwardly causes the pressure above the plunger to be relieved via the groove 1 8 and the port 17.

The parts described above are substantially conventional.

For many years, it has been known that the noise known as "diesel knock" can be reduced by arranging for an initial small ("pilot") charge of fuel to be passed to the engine barrel before a further "main" charge of fuel is passed thereto.

U.S. Pat. No. 4,824,341 discloses an injection pump which provides an initial pilot charge before the main charge of the fuel. There are, however, a number of practical difficulties with the arrangements set out in that U.S. Patent Specification. A pair of recesses (11) and (14) are provided in the wall of the cylinder, these two recesses being generally rectangular in shape and clearly it is difficult to acurately produce such recesses within the close confines of a cylinder. Furthermore for the apparatus to operate accurately, it is necessary for the lower and/or upper edges of those recesses (11), (14) to be very accurately aligned and clearly this is difficult to do given the constraints of machining within a small diameter cylinder.

The present invention provides a liquid pump comprising a cylinder, a piston reciprocable within the cylinder and generally sealing with the cylinder, the cylinder having a closed end including a liquid outlet port, means to introduce a liquid into said closed end of said cylinder, and said piston including, on its peripheral surface, helical groove means fluidly connected to the closed end of the cylinder, said piston including further means to communicate said port with said closed end of said cylinder when the piston is in a position (C-D) between a position (A-B) in which the port directly communicates with the closed end of the cylinder and a position (E) in which the port communicates with the helical groove means, said further means comprising a second groove in the peripheral surface of the piston between said helical groove means and the part of the piston adjacent the closed end of the cylinder, characterised in that said further means further comprises a cutaway portion in the wall of said cylinder to communicate with said second groove, said cutaway portion being coaxial with an axis of said port means.

Such an arrangement is extremely effective and is also simple to manufacture. Because the cutaway portion 22 and port means 17 are coaxial, it is possible to manufacture them with the same tool and indeed it is intended that the port means 17 and cutaway portion 22 may be formed by the same rotating drill.

In a preferred arrangement, a plurality of respective pairs of port means and cutaway portions can be provided which assists in the flow of fluid through the cutaway portion and second groove when the pilot charge is to be cut off.

The helical grooves means need not extend at a constant angle to the axis along its length.

The arrangement may be such that in use, as the piston (plunger) moves further towards the closed end of the cylinder (barrel), it initially closes off the port; further movement of the plunger pressurises the liquid within the closed end of the barrel so that liquid passes out of said outlet (the pilot charge); further movement of the plunger brings the further groove into communication with the port and the cutaway portion, whereby liquid pressure within the closed end is relieved; further movement of the plunger towards the closed end of the barrel closes communication thereby pressurising liquid in the closed end of the cylinder so that liquid passes out of said outlet (the main charge); and further movement of the plunger towards the closed end of the cylinder brings the first mentioned groove into communication with the port thereby relieving the liquid pressure in the closed end.

Figure 3:
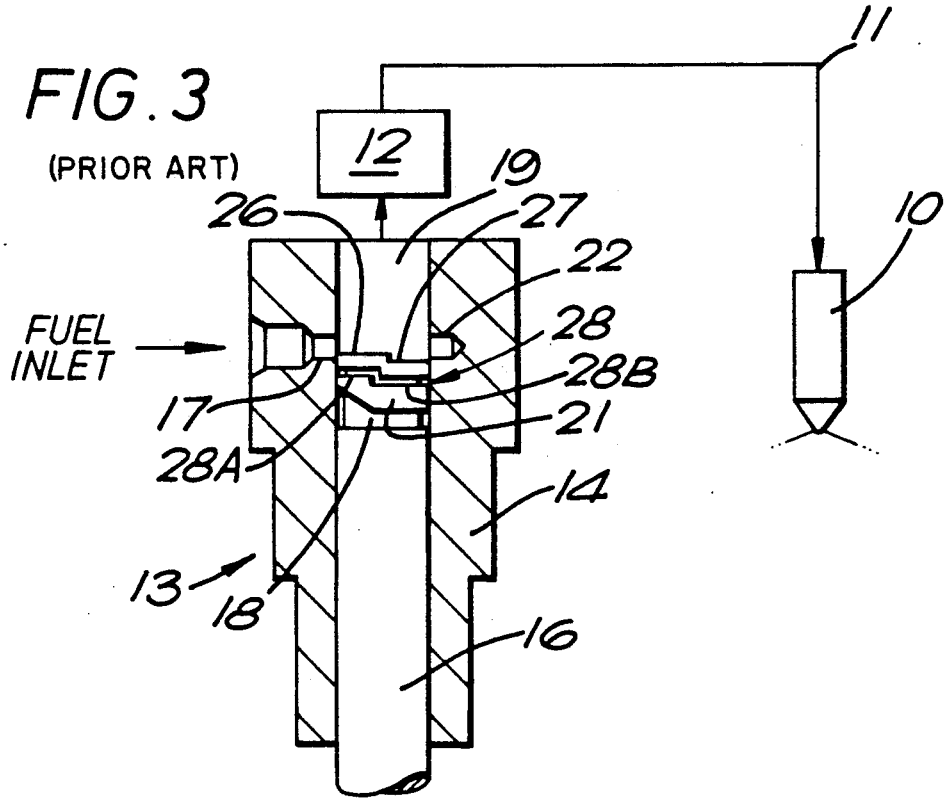
FIG. 3 (PRIOR ART)
Figure 4:
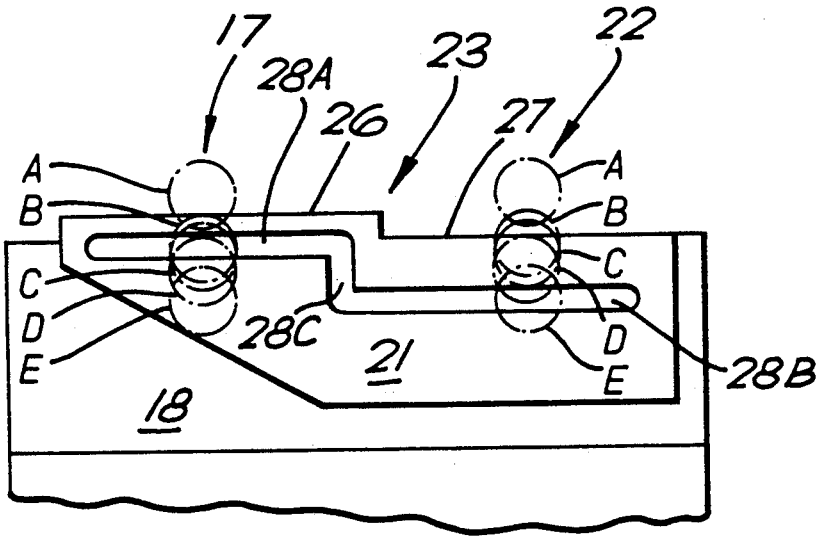
Figure 5:
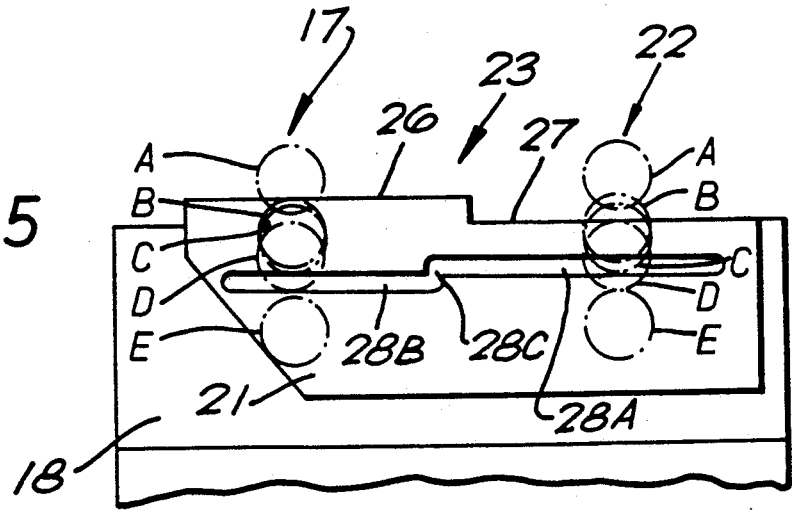
Figure 6:
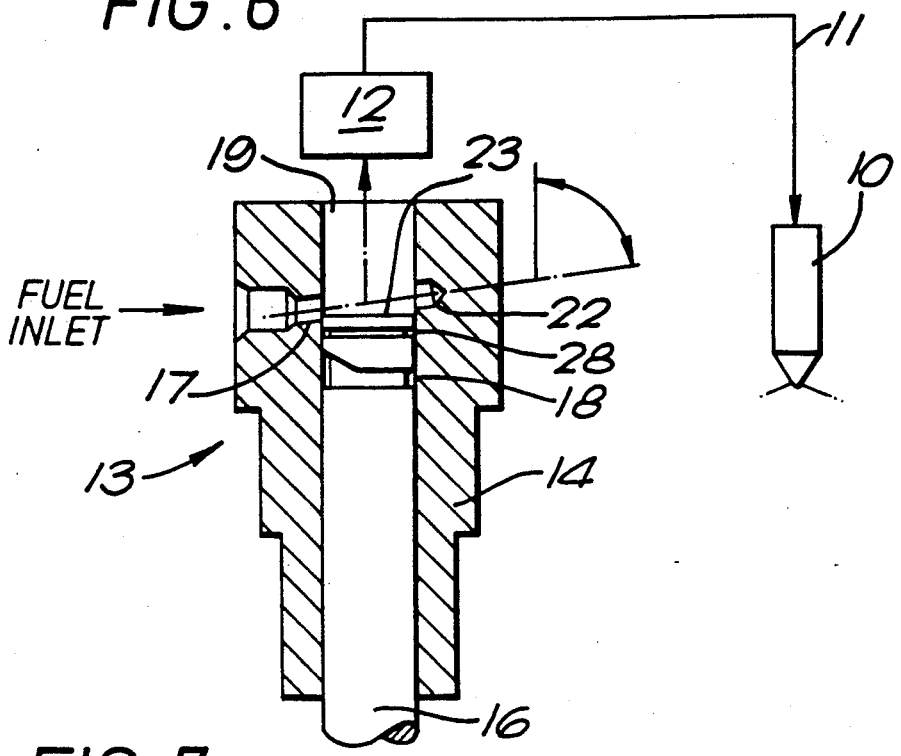
Figure 7:
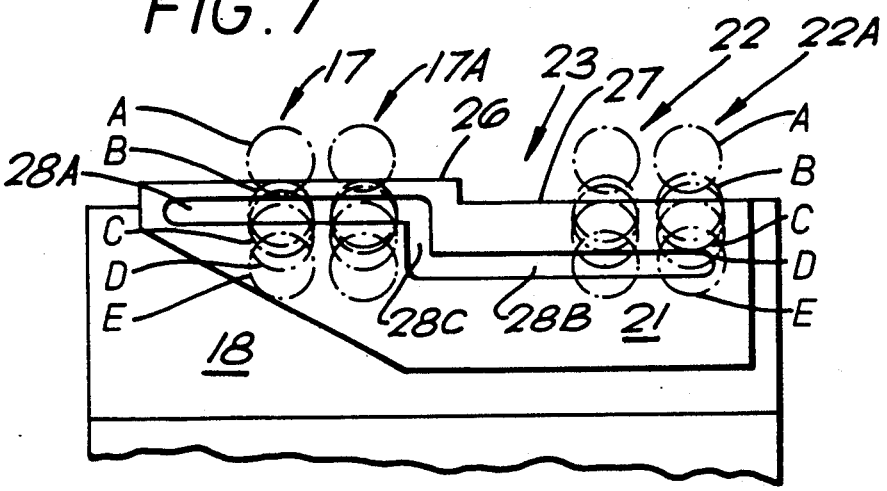
Figure 8:
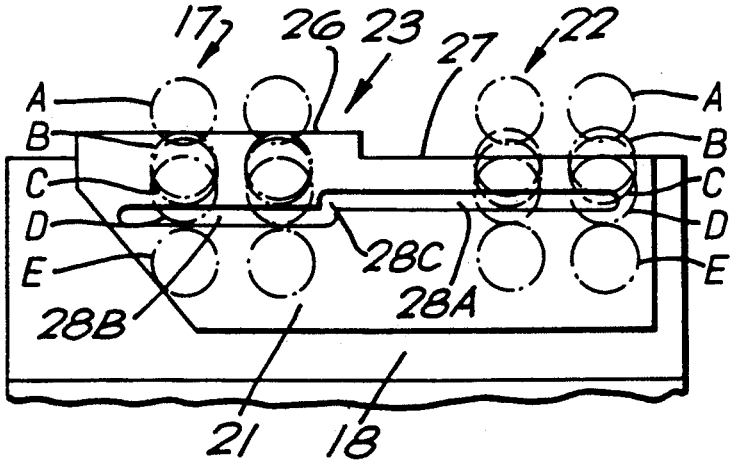

Preferred arrangements of the invention will now be described by way of example only and with reference to the accompanying drawings in which:

FIG. 3 is a diagrammatic view similar to FIG. 1 of a pump according to the invention, FIG. 4 is a developed view similar to FIG. 2 of the portion of the plunger of the pump and FIG. 2 also showing the position of the port, FIG. 5 is a view similar to FIG. 4 of an alternative arrangement according to the invention, FIG. 6 is a view similar to FIG. 3 of an alternative arrangement of the invention and, FIGS. 7 and 8 are views corresponding to FIGS. 4 and 5 of alternative arrangements of the invention In FIG. 3 to 8, similar parts have been given the same reference numerals as the parts in FIGS. 1 and 2.

Referring now to FIG. 3, it will be seen that opposite the port 17 there is provided in the side wall of the barrel 14 a cutaway portion in the form of a blind "bypass" bore 22 which in practice is formed at the same time as the port 17 by extending the cutting drill across the barrel 14 into the wall opposite the port 17. The upper surface 23 of the plunger 16 adjacent the closed end 19 is stepped so as to provide an upper step 26 and a lower step 27. In the arrangement described, the two steps 26,27 are substantially semi circular in plan. Between the upper surface 23 of the plunger 16 and the groove 18 there is provided a second groove 28 in the circumferential surface 21, the shape and purpose of which will become apparent.

We now refer to FIG. 4. In addition in the position of the port 17 there is disclosed the corresponding positions of the bypass bore 22. The shape of the second groove 28 is clear from FIG. 4 and in particular, it comprises an upper circumferential part 28A, a lower circumferential part 28B and an interconnecting part 28C.

In FIG. 4 there are shown five relative positions between the plunger and port labelled A to E, positions A, B and E corresponding to positions I, II, and III of FIG. 2 respectively.

When the port 17 is between position A and B it communicates directly with closed end 19. Between positions B and C the port 17 communicates with the upper circumferential part 28A of the second groove 28 and the bypass bore 22 is in a communicates with the closed end 19 only. As the plunger moves from B to C it pressurises the liquid in the closed end 19 and pumps out liquid via the delivery valve 12 to provide the pilot charge.

When however the plunger moves to a position in which the port is between C and D, the port 17 communicates with the second groove 28, and the bypass bore 22, as well as communicating with the closed end 19 also communicates with the lower circumferential part 28B of the second groove 28. In this position, therefore, the closed end 19 communicates with the port 17 via the second groove 2B and so, pressure within the closed end 19 is relieved. Thus, the pump stops pumping liquid through the delivery valve 12 and further movement of the plunger 16 upwards simply allows liquid to pass from the closed end 19 through the bypass bore 22, and second groove 28 to the port 17.

When, however, the plunger moves to a position between D and E the bypass bore 22 ceases to communicate with the closed end 19 and so, the closed end 19 becomes isolated and further movement of the plunger pressurises the liquid within the closed end 19 so that it passes out of the delivery valve 12 to provide the main charge.

When the plunger moves to a position in which the port 17 is in position E, then pressure within the closed end 19 is relieved via groove 18 in the same manner as the embodiment of FIGS. 1 and 2.

Fundamentally, means has been provided so that for a short instant whilst the plunger 16 is pumping liquid out of the closed end 19 through the delivery valve 12, the pressure in the closed end 19 is relieved so that instead of a single pressure pulse being passed through to the injector 10, two separate pulses are provided. However, it will be understood that it is essential that the first pulse and the interval between the first and second pulses are very short, and are indeed shorter than would be provided, for example, by the passage of a groove or land across the port 17.

The short interval for the first pulse is provided by the overlapping nature of the port 17 with the upper step 26 and upper circumferential part 28A on the one hand and the bypass bore 22 with the lower step 27 and lower circumferential part 28B on the other hand. The exact timing and duration of the first small pressure pulse may be varied by changing the relative dispositions of the upper step 26 and upper circumferential part 28A, and lower step 27 and lower circumferential part 28B.

The short interval for the interval between the first and second pulses is provided by the overlapping nature of the bypass bore 22 with the lower step 27 (position C) on the one hand and, with the circumferential part 28B (position D) on the other hand. The exact time and duration of this interval may be varied by changing the relative dispositions of the lower step 27 and the circumferential part 28B.

In FIG. 6 the bypass bore 22 is arranged above the port 17 and so, the upper surface 23 of the plunger need not have two steps, but can be flat. Furthermore, the second groove 28 does not necessarily need a step with an upper and lower circumferential part 28A, 28B, but can comprise a single circumferential part. Effectively, the arrangement of FIG. 6 corresponds to FIG. 3 and 4, except that the bypass bore 22, lower step 27 and lower circumferential part 28B of the further groove 28 are raised together. This simplifies manufacture of the plunger and can be dealt with by utilising an off-radial tool to drill both the port 17 and bypass bore 22.

The operation of the configuration of FIGS. 3, 4, and 6, can be summarised in the following table.

TABLE 1

| POSITION | PORT 17 CONNECTS WITH: | BORE 22 CONNECTS WITH: | PUMP |
|---|---|---|---|
| A to B | Closed end 19 and/or groove 28 | Closed end 19 | No, pressure relieved direct to port 17 |
| B to C | Second groove 28 | Closed end 19 only | Yes, pilot pump |

TABLE 1-continued

| POSITION | PORT 17 CONNECTS WITH: | BORE 22 CONNECTS WITH: | PUMP |
|---|---|---|---|
| C to D | Second groove 28 | Closed end 19 and second groove 28 | No, pressure relieved via bypass bore, groove 28 and port 17 |
| D to E | Second groove 28 then side of piston | Second groove 28 only | Yes, main pump |
| Below E* | Groove 18 | Second groove 28 or plunger sidewall | No, pressure relieved via groove 18 |

*Below E, ie plunger is above port 17.

An alternative arrangement is illustrated in FIG. 5. In this, the upper circumferential part 28A and lower circumferential part 28B are transposed. As a result, the interconnections are varied as set out in the

TABLE 2

| | PORT 17 CONNECTS WITH:- | BORE 22 CONNECTS WITH: | PUMPS? |
|---|---|---|---|
| A to B | Closed end 19 | Closed end 19 only | No Pressure relieved direct to port 17 |
| B to C | Side of Plunger | Closed end 19 and second groove 28 | Yes, Pilot pump |
| C to D | Second groove 28 | Closed end 19 and second groove 28 | No, Pressure relieved via bypass bore, second groove, and port 17 |
| D to E | Second groove, then side of plunger | Second groove 28 then side of plunger | Yes, main pump |
| E* and below | Groove 18 | Side of plunger | No, pressure relieved via groove 18 and port 17 |

It will be understood, therefore, that means has been provided to arrange for the pumping of an initial or pilot charge of fuel to the injector 10, followed by a break and then the main charge. The pilot charge is pumped during the interval between positions B and C and the main charge is pumped after the port and plunger pass the relative position D. By varying the positions C and D one can vary the timing and duration of the pilot charge.

Other configurations may be utilised. For example, the upper surface 23 of the plunger (whether or not it includes upper and lower steps) need not be circumferential, but could be provided at an angle to the axis and in particular, could be helical. In this way, the injection timing or quantity of fuel to be provided during the pilot injection can be set to vary with engine load.

The edges of the groove 28 and the top edge of the plunger and also the groove 18 can be chamfered or have a stepped form (with different radial depths). In this way the injection timing or quantity can be set to vary with engine speed. The steps or chamfers provide some control over the rate of fuel pressure rise or decay.

Furthermore, the pump described can be used with an electronically controlled spill valve. This could be used to control some of the timing events, for example, the timing of the end of the main injection.

As described above the first small injection depends on the axial movements between positions B and C. However, it may be necessary for the bypass port to spill before the main port is position C to occur before position B. At slow plunger speeds no initial injection will occur but at high speeds the restrictions in the ports and grooves would be sufficient to create enough pressure for injection. If this is the case then the step in the groove may not be necessary—it may become a simple circumferential groove.

The separation of the two injections is set by the plunger dimensions (including the step in the top of the plunger). This could be set so that the injection was not split but with the first portion of the (single) injection having a lower injection rate.

Referring now to FIGS. 7 and 8, there is shown in FIG. 7 an arrangement corresponding to FIG. 4 except that there is provided a second port 17A and a corresponding second bypass bore 22A. These are arranged at an angle with respect to the other pair of port 17 and bore 22. The advantage of such an arrangement is that it provides an additional fluid path flow for fluid to flow from above the piston 16 when the lower edge of the bore 22 first contacts the groove 28B (i.e. in the position C both in FIGS. 7 and 8. This assists in accurately cutting of the pilot charge.

Finally, it is to be understood that various alterations, modifications and/or additions may be incorporated into the various constructions and arrangements of parts without departing from the spirit and ambit of the invention. Additionally, the invention is not to be limited only to the described embodiments, but rather only by the appended claim.

I claim:

1. A liquid pump comprising a cylinder, a piston reciprocable within the cylinder and generally sealing with the cylinder, the cylinder having a closed end including a liquid outlet, port means to introduce a liquid into said closed end of said cylinder, and said piston including, on its peripheral surface, helical groove means fluidly connected to the closed end of the cylinder said piston including further means to communicate said port with said closed end of said cylinder when the piston is in a position between a position in which the port directly communicates with the closed end of the cylinder and a position in which the port communicates with the helical groove means, said further means comprising a second groove in the peripheral surface of the piston between said helical groove means and the part of the piston adjacent the closed end of the cylinder, characterised in that said further means further comprises a cutaway portion in the wall of said cylinder to communicate with said second groove, said cutaway portion being coaxial with an axis of said port means.

2. A pump as claimed in claim 1 characterised in that aid cut away portion is formed by the same tool as the port means.

3. A pump as claimed in claim 1 characterised in that said cut away portion and said port means are of circular cross section.

4. A pump as claimed in claim 1, characterised in that said second groove comprises two part circumferential parts connected by a part extending in a non circumferential direction, a first of which co-operates with the port means and the second of which co-operates with the cutaway portion.

5. A pump as claimed in claim 1, or characterised in that the common axis of the port means and the cutaway portion, is inclined at an angle of less than 90° to the axis of the piston, towards the liquid outlet.

6. A pump as claimed in claim 5 characterised in that in use, as the piston moves further towards the closed end of the cylinder, it initially closes off the port; further movement of the piston pressurises the liquid within the closed end of the cylinder so that liquid passes out of said outlet to provide a pilot charge; further movement of the piston brings the second groove into communication with the port and the cutaway portion, whereby liquid pressure within the closed end is relieved; further movement of the piston toward the closed end of the cylinder closes communication thereby pressurising liquid in the closed end of the cylinder so that liquid passes out of said outlet to provide the main charge and further movement of the piston towards the closed end means of the cylinder brings the helical groove means into communication with the port thereby relieving the liquid pressure in the closed end.

7. A pump as claimed in any of claim 6 characterised in that there is provided more than one port means and respective coaxial cut away portion.

* * * * *

UNITED STATES PATENT AND TRADEMARK OFFICE

CERTIFICATE OF CORRECTION

PATENT NO. : 5,020,979

DATED : June 4, 1991

INVENTOR(S) : James M.A. Askew

It is certified that error appears in the above-identified patent and that said Letters Patent is hereby corrected as shown below:

Col. 3, line 67, delete "2B" and insert ---28---.

Col. 5, line 19, after "out in the" insert

---following table;---.

Signed and Sealed this

Twenty-second Day of September, 1992

*Attest:*

DOUGLAS B. COMER

*Attesting Officer*

*Acting Commissioner of Patents and Trademarks*